United States Patent [19]

Koehler

[11] 4,367,447

[45] Jan. 4, 1983

[54] ELECTROMAGNETIC RELAY HAVING A PIVOTED ARMATURE FITTED WITH A PERMANENT MAGNET

[75] Inventor: Gerard Koehler, Ville-D'Avray, France

[73] Assignee: Ets Bernier & Cie, Paris, France

[21] Appl. No.: 242,390

[22] Filed: Mar. 10, 1981

[30] Foreign Application Priority Data

Mar. 21, 1980 [FR] France ..... 80 06302

[51] Int. Cl.[3] ..... H01H 51/22

[52] U.S. Cl. ..... 335/80; 335/234

[58] Field of Search ..... 335/78, 79, 80, 81, 335/82, 83, 95, 203, 232, 234, 235, 179, 181

[56] References Cited

U.S. PATENT DOCUMENTS 2,741,728 4/1956 Distin ..... 335/234

FOREIGN PATENT DOCUMENTS 2262669 6/1974 Fed. Rep. of Germany .
2407184 8/1975 Fed. Rep. of Germany .
2271654 12/1975 France .
2392484 12/1978 France .

OTHER PUBLICATIONS

Bell Laboratories Record, vol. 41, pp. 241–243 "A Miniature Latch-In Relay for the Telstar Satellite" by C. Schneider, Jun. 1963 (Murray Hill).

*Primary Examiner*—Harold Broome
*Attorney, Agent, or Firm*—Young & Thompson

[57] ABSTRACT

In a bistable electromagnetic relay composed of a U-shaped yoke provided with excitation coils, the arms of the yoke are inserted between the pole-pieces of a pivotally mounted H-shaped armature comprising a permanent magnet. A flexible strip attached to the armature carries two movable contacts which are applied against two stationary contacts in order to provide an electrical connection between the contacts. Only a very small proportion of the flexible strip performs a conducting function, there is no permanent connection between the strip and a fixed terminal, and a very short path is provided for current flow. The double-break action of the relay has the effect of reducing stray capacitance between open contacts.

10 Claims, 5 Drawing Figures

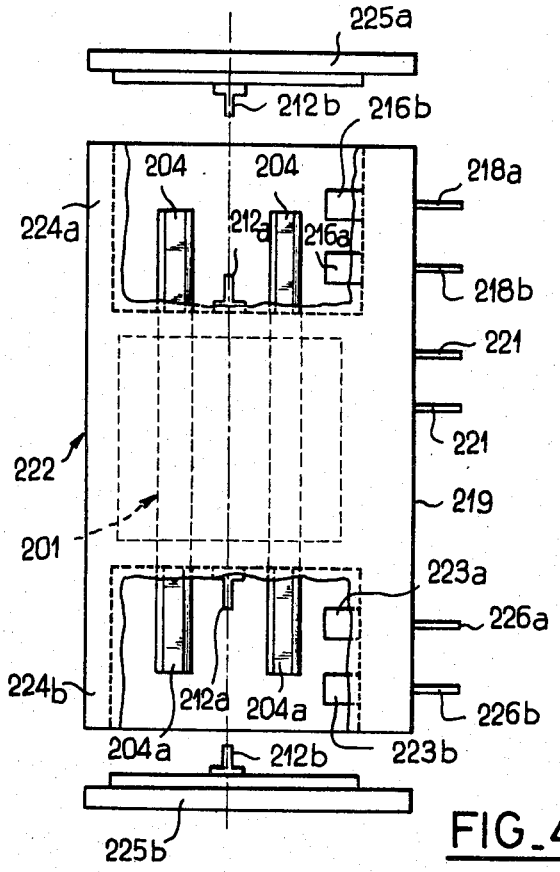
FIG_4
FIG_5
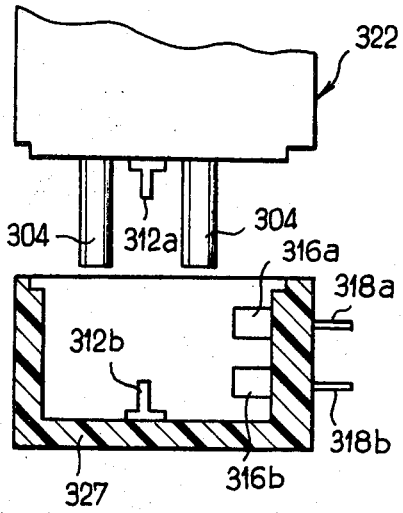
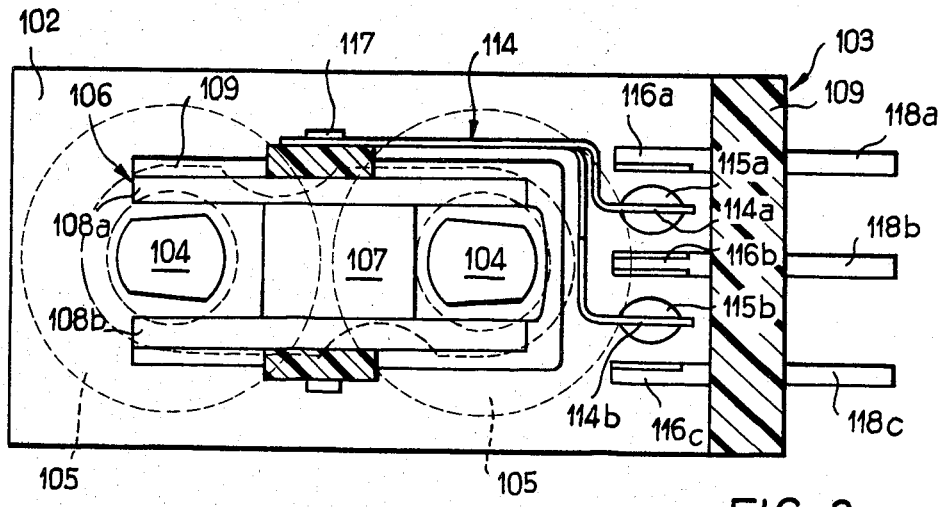
FIG_3

ELECTROMAGNETIC RELAY HAVING A PIVOTED ARMATURE FITTED WITH A PERMANENT MAGNET

This invention relates to a bistable electromagnetic relay with a pivoted armature fitted with a permanent magnet.

A relay of this type is essentially composed of a U-shaped yoke fixed on a base and provided with one or two excitation coils. Said yoke cooperates with an H-shaped armature formed by a permanent magnet which constitutes the crossbar of the H and on which are fixed two projecting plates forming pole-pieces and constituting the arms of the H. The ends of the yoke are positioned with a substantial clearance between said arms and, depending on the respective polarities applied to the yoke ends, the projecting plates close against the arms in an oblique position of the armature, either in one direction or in the other.

The pivoted armature is covered externally with an insulating material and adapted to carry flexible strips. Said strips are in turn adapted to carry movable contacts and extend along the arms of the H in order to cooperate with stationary contacts carried by the base.

Known relays of this type suffer from a certain number of disadvantages. On the one hand, they entail the need for a flexible electrical connection between the output terminals and the movable flexible strips attached to the armature. On the other hand, this construction involves a current flow path of substantial length within the relay. Finally, since relays of this type are of the single-break type, they result in high stray capacitance between the open contacts.

The aim of the present invention is to provide a pivoted-armature relay which is free from the disadvantages mentioned above.

In accordance with the invention, the electro-magnetic relay with a pivoted armature is designed in the manner described in the foregoing and is distinguished by the fact that the free end of each flexible strip carries two electrically coupled movable contacts adapted to cooperate with stationary contacts for connecting said contacts to each other.

In order to carry out the contact-closing operation, a very short bridging of the stationary contacts is provided by an electrical connection between the movable contacts, this connection being established only over a very small portion of the flexible strip. In consequence, said strip does not need to be permanently coupled to a fixed terminal by means of any connection and a very short path is provided for the flow of current within the relay. Moreover, this double-break action reduces the stray capacitance between open contacts.

In a preferred embodiment of the invention, the axis of rotation of the armature is located between the stationary contacts and the point of attachment of the flexible strip to the armature.

This arrangement has the effect of increasing lateral friction between the movable contacts and the stationary contacts as well as the self-cleaning action at the time of closing of the contacts.

In a preferred embodiment of the invention, the two movable contacts of one and the same strip remain located in the same plane parallel to the axis of the yoke and the corresponding stationary contacts are located in the same plane parallel to the plane of the yoke; that face of the base which carries said stationary contacts is perpendicular to the plane of the yoke and parallel to the axis of said yoke.

In consequence, no curved portion is necessary between the stationary contacts and the output terminals corresponding to said contacts.

In a first alternative embodiment of the invention, the relay comprises two stationary flexible strips on each side of the armature. Said strips are intended to cooperate with two respective pairs of stationary contacts in order to constitute a double-break changeover contact circuit without common point.

In a second alternative embodiment, the relay comprises three equidistant stationary contacts spaced at predetermined intervals and a flexible strip curved in such a manner as to ensure that a movable contact is located within each interval between the stationary contacts, the movable contacts being relatively displaced by the value of the interval aforesaid.

There is thus obtained a double-break changeover contact circuit with common point.

In an improved embodiment of the invention, each arm of the yoke is fitted with a coil and the end portions of said arms are provided with flat surfaces in order to cooperate in juxtaposed planes with the projecting plates of the pivoted armature in its angular end-positions.

Preferably, the assembly formed by the yoke and its coils is encapsulated in an insulating material so as to form a parallelepipedal block. A first face of the block is adapted to carry coil connection terminals and stationary contacts. The end portions of the yoke arms are adapted to project from a second block face which is perpendicular to the first, said second face being provided with means for pivotally mounting and centering the armature in coaxial relation to the yoke.

A perfectly protected block is thus formed and only the ends of the yoke and the terminals to be connected emerge from said block. In consequence, the coil is not liable to pollute the contacts.

In a first form of construction, the aforementioned second face of the block is surrounded by a skirt which forms an extension of said block and encloses the end portions of the yoke arms. Said skirt is intended to be fitted with a lid which comprises part of the means for pivotal mounting and centering of the armature.

The operation of the relay can thus be inspected prior to fitting of the lid. Furthermore, said lid is easier to manufacture than a housing.

In a second form of construction, the relay comprises a removable trough which can be fitted on the aforementioned second face of the block. The means for pivotal mounting and centering of the armature are mounted on the bottom wall of the trough and stationary contacts are mounted on one of the side walls of said trough.

This form of construction permits the use of two different insulating materials for encapsulation and for the trough. The trough insulating material may be adapted, for example, to high-frequency insulation.

In an advantageous embodiment of the invention, the yoke has two additional arms opposite to the first arms. Said additional arms are arranged symmetrically and encapsulated together with said first arms within one and the same block so as to cooperate with a second armature which is symmetrical with the first and provided with similar contact circuits.

These and other features of the invention will be more apparent upon consideration of the following description and accompanying drawings, wherein:

FIG. 3 is a view which is similar to FIG. 1, in one alternative embodiment;

FIG. 4 is an exploded side view of a relay in a particular embodiment, in which it is assumed that the armature has been removed;

FIG. 5 is a fragmentary exploded view in another embodiment, in which it is assumed that the armature has been removed.

Figure 1:
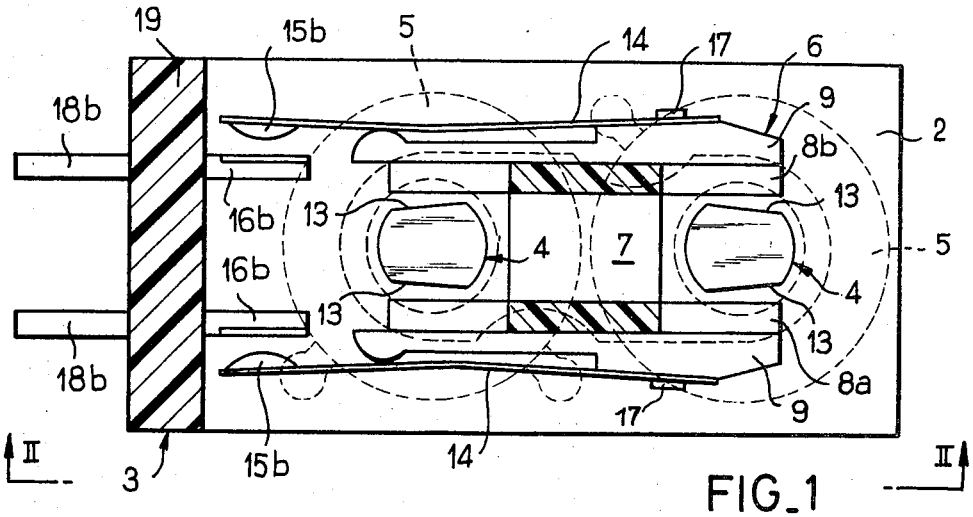
FIG. 1 is a sectional view of a relay in accordance with the invention, this view being taken along line I—I of FIG. 2.
Figure 2:
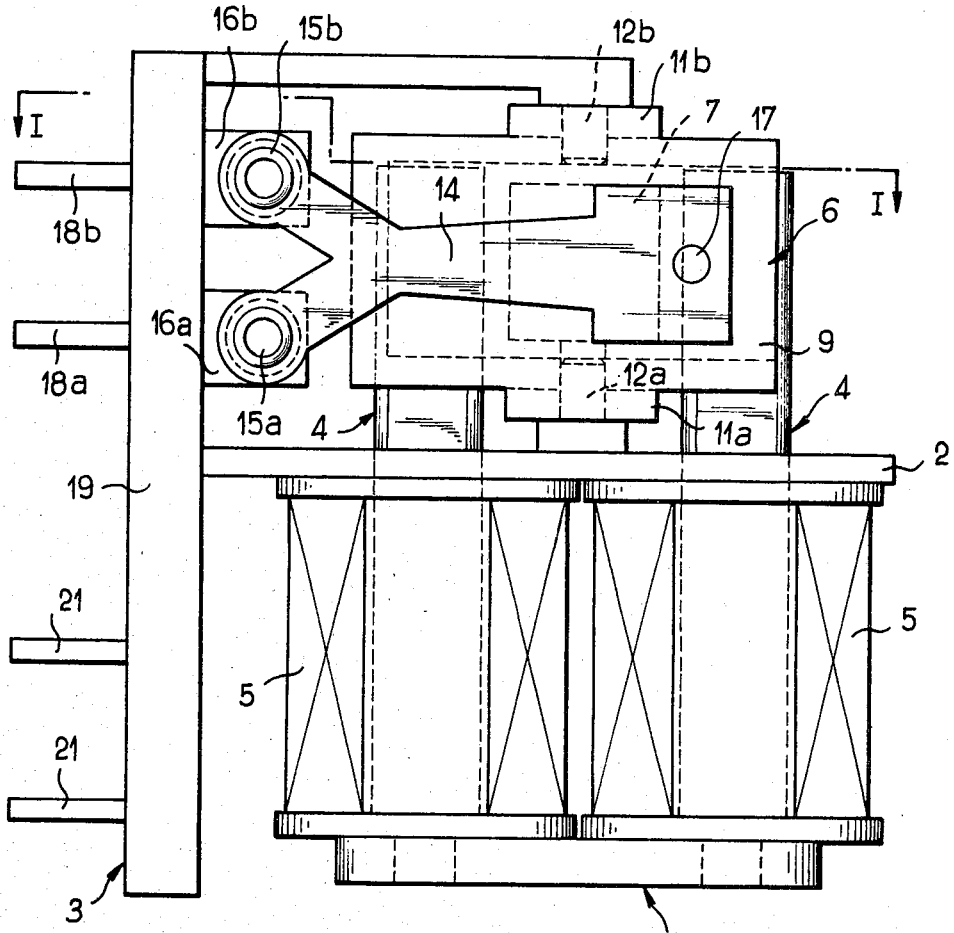
FIG. 2 is a side view taken along line II—II of FIG. 1.

Referring now to FIGS. 1 and 2, a relay in accordance with the invention comprises a U-shaped yoke 1 fixed on a plate 2 of a base 3, said yoke being provided with two arms 4 on which are wound coils 5. The two arms 4 project from the plate 2 and are placed with a substantial clearance between the arms of an H-shaped pivoted armature 6, the axis of pivotal displacement being intended to coincide with the axis of the yoke 1.

Said armature is essentially constituted by a permanent magnet 7 forming the crossbar of the H and by two projecting plates 8*a* and 8*b* which form pole-pieces. Said plates are provided externally with an insulating covering 9 completed by two insulating plates 11*a*, 11*b* which cover the magnet 7. Recesses are formed in said plates for accommodating pivots 12*a*, 12*b* which are rigidly fixed to a base 3. Said pivots permit centering and pivotal displacement of the armature 6. The ends of the yoke arms 4 are provided with flat surfaces 13 so arranged as to permit cooperation of the projecting plates 8*a*, 8*b* with said arms in juxtaposed planes.

Two flexible strips 14 of conductive material are each fixed at one end on the insulating covering 9 so as to extend along each projecting plate 8*a*, 8*b*. Two movable contacts 15*a*, 15*b* are fixed at the other end of each strip in order to cooperate with stationary contacts 16*a*, 16*b*. The point of attachment 17 of each strip is located in a position such that the axis of the pivots 12*a*, 12*b* is located between the movable contacts and said point of attachment.

The stationary contacts 16*a* and 16*b* corresponding to one and the same strip are located in one and the same plane parallel to the plane of the yoke 1 and are connected directly and without bending to respective terminals 18*a*, 18*b* which project from one face 19 of the base which carries said contacts, namely the face which is perpendicular to the plane of the yoke and parallel to the axis of the yoke. Said face 19 is also adapted to carry the output terminals 21 of the coils 5 (this connection is not shown in the drawings).

It is observed that, during the movement of rotation of the armature 6, the movable contacts remain located in the same plane parallel to the axis of the yoke.

During operation, when a given polarity is applied to the arms 4 of the yoke 1, the armature 6 undergoes a pivotal displacement in such a manner as to ensure, for example (referring to FIG. 1), that the plate 8*a* is applied against the left-hand arm 4 and that the plate 8*b* is applied against the right-hand arm. The movement of the lower strip 14 then has the effect of applying the movable contacts 15*a*, 15*b* against the stationary contacts 16*a*, 16*b* (as shown in FIG. 2). Said stationary contacts are then connected electrically by a very short portion of the strip 14 which has negligible resistance.

If the polarities of the yoke arms are reversed, the armature 6 undergoes a pivotal displacement in the opposite direction, the lower contacts (shown in FIG. 1) open and the upper contacts close. The operation is therefore of the bistable type and the rotary armature provides good impact resistance.

The location of the point 17 of attachment of each movable strip produces a substantial lagging action which results in lateral friction between the movable contacts and the stationary contacts at the time of closing, thus having a self-cleaning effect on the contacts.

It will be noted that, apart from their contact-carrying ends, the strips 14 do not perform any conducting function and do not need to be attached to an output terminal by means of a connection which would have to be flexible.

Furthermore, the double-break operation endows the relay with a considerably higher breaking capacity and has the effect of reducing stray capacitance.

The relay described in the foregoing constitutes a double-break changeover circuit without a common point.

Referring to FIG. 3, there will now be described a relay which forms a double-break changeover-contact circuit with a common point.

This embodiment is somewhat similar to the preceding embodiment and will therefore be described only in regard to its distinguishing features.

A U-shaped yoke provided with two coils 105 has two arms 104 located between the arms 108*a*, 108*b* of a pivotally mounted H-shaped armature 106 comprising a permanent magnet 107. On one face of its insulating covering 109, said armature is adapted to carry a flexible strip 114 which has two arms 114*a*, 114*b*. Each arm is adapted to carry a movable contact 115*a*, 115*b* respectively, each contact being intended to operate on both faces of the strip.

Three stationary contacts 116*a*, 116*b*, 116*c* are arranged on the face 119 of the base 103 so as to ensure that they are uniformly spaced at predetermined intervals. These contacts have extensions in the form of terminals 118*a*, 118*b*, 118*c*.

The distance between the arms 114*a* and 114*b* of the strip 114 is equal to each interval mentioned above, with the result that, in one end position of the armature 6, the movable contact 115*a* comes against the contact 116*a* and the movable contact 115*b* comes against the contact 116*b* whereas, in the other end position, the movable contact 115*a* comes against the contact 116*b* and the movable contact 115*b* comes against the contact 116*c*.

A connection is therefore established either between the contacts 116*a* and 116*b* or between the contacts 116*b* and 116*c*, thus effectively providing a changeover-contact circuit with a common point.

In a practical embodiment of the invention (as shown in FIG. 4), the assembly formed by the yoke and the coils is encapsulated in a block 222 of insulating material. In FIG. 4, there is shown an alternative embodiment in which the yoke 201 has two additional arms 204*a* at the end remote from the arms 204 and disposed symmetrically in order to cooperate with a second armature (not shown) corresponding to two other pairs of stationary contacts 223*a*, 223*b*.

The block 222 is extended on each side of the relay by a skirt which is designated respectively by the references 224*a*, 224*b* and in which are fixed the stationary contacts.

The pivots 212*a* of the armature are rigidly fixed to the block 222 whereas the pivots 212*b* are rigidly fixed to removable lids 225*a*, 225*b* which are intended respectively to close the skirts 224*a*, 224*b*. Before the lids are fitted in position, the skirts are designed to protect the moving parts of the relay.

During normal service, the only elements which project from the block on the face 219 are the terminals which serve to connect the contacts 218*a*, 218*b*, 226*a*, 226*b*, and the coil connection terminals 221.

In an alternative embodiment (shown in FIG. 5), the skirts are dispensed with; a trough 327 which is adapted to cooperate with the block 322 performs the functions both of skirt and lid. A pivot 312*b* for the armature (not shown) is fixed on the bottom wall of the trough. The stationary contacts 316*a*, 316*b* which form extensions of the terminals 318*a*, 318*b* are fixed on one of the side walls of the trough.

By virtue of this arrangement, a different insulating material can be provided for the block 222 and for the trough 327 which carries the contacts. In particular, a material which is well suited to encapsulation can be chosen for the block and a material which affords good insulation at high frequencies can be chosen for the trough.

As will readily be apparent, the invention is not limited to the examples hereinabove described and a number of minor alternative forms of construction may accordingly be contemplated without thereby departing either from the scope or the spirit of the invention.

What is claimed is:

1. An electromagnetic relay with a pivoted armature, comprising a U-shaped yoke fixed on a base and provided with at least one coil for cooperating with an H-shaped armature rotatably mounted on said base so as to rotate about the axis of the yoke, the armature comprising a permanent magnet which forms the crossbar of the H and projecting plates secured to said magnet and forming pole-pieces, the end portions of the yoke being positioned between said pole-pieces on each side of the magnet, at least one contact-carrying flexible strip being fixed at one end thereof and externally on the pole-pieces by means of an interposed insulating covering so as to extend in a direction parallel to the arms of the H and in such a manner as to cooperate with stationary contacts rigidly fixed to one face of the base, wherein the free end of each flexible strip carries two electrically coupled movable contacts adapted to cooperate with two respective stationary contacts for connecting said two stationary contacts to each other.

2. A relay according to claim 1, wherein the point of attachment of the flexible strip to the armature is located beyond the axis of rotation of said armature with respect to the stationary contacts.

3. A relay according to claim 1 or claim 2, wherein the two movable contacts of one and the same strip remain located in the same plane parallel to the axis of the yoke and wherein the corresponding stationary contacts are located in the same plane parallel to the plane of the yoke, that face of the base which carries said stationary contacts being perpendicular to the plane of the yoke and parallel to the axis of said yoke.

4. A relay according to claim 1, wherein said relay comprises two flexible strips on each side of the armature, said strips being adapted to cooperate with two respective pairs of stationary contacts.

5. A relay according to claim 1, wherein said relay comprises three equidistant stationary contacts spaced at predetermined intervals and a flexible strip curved in such a manner as to ensure that a movable contact is located within each interval between the stationary contacts, the movable contacts being spaced from each other displaced by the value of the interval aforesaid.

6. A relay according to claim 1, wherein each arm of the yoke is fitted with a coil, the end portions of said arms being provided with flat surfaces in order to cooperate in juxtaposed planes with the projecting plates of the pivoted armature in its angular end-positions.

7. A relay according to claim 1, wherein the assembly formed by the yoke and its coils is encapsulated in an insulating material so as to form a parallelepipedal block a first face of the block being adapted to carry coil connection terminals and stationary contacts, the end portions of the yoke arms being adapted to project from a second block face which is perpendicular to the first, said second face being provided with means for pivotally mounting and centering the armature in coaxial relation to said yoke.

8. A relay according to claim 7, wherein the aforementioned second face of the block is surrounded by a skirt which forms an extension of said block and encloses the end portions of the yoke arms, said skirt being intended to be fitted with a lid comprising part of the means for pivotal mounting and centering of the armature.

9. A relay according to claim 7, wherein said relay comprises a removable trough adapted to be fitted on the aforementioned second face of the block, part of the means for pivotal mounting and centering of the armature being mounted on the bottom wall of said trough and stationary contacts being mounted on one of the side walls of said trough.

10. A relay according to claim 8 or claim 9, wherein the yoke has two additional arms located opposite to the first arms, arranged symmetrically and encapsulated together with said first arms within one and the same block so as to cooperate with a second armature which is symmetrical with the first and provided with similar contact circuits.

* * * * *